US009856761B2

(12) United States Patent
Iwasaki

(10) Patent No.: US 9,856,761 B2
(45) Date of Patent: Jan. 2, 2018

(54) VALVE TIMING CONTROLLER, LOCK JIG FOR VALVE TIMING CONTROLLER, AND PRODUCTION METHOD OF VALVE TIMING CONTROLLER

(71) Applicant: DENSO CORPORATION, Kariya, Aichi-pref. (JP)

(72) Inventor: Akira Iwasaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 140 days.

(21) Appl. No.: 15/083,781

(22) Filed: Mar. 29, 2016

(65) Prior Publication Data

US 2016/0298506 A1 Oct. 13, 2016

(30) Foreign Application Priority Data

Apr. 7, 2015 (JP) ..... 2015-078341

(51) Int. Cl.
*F01L 1/34* (2006.01)
*F01L 1/352* (2006.01)
*F01L 1/02* (2006.01)

(52) U.S. Cl.
CPC ..... *F01L 1/352* (2013.01); *F01L 1/022* (2013.01); *F01L 2103/01* (2013.01); *F01L 2820/032* (2013.01)

(58) Field of Classification Search
CPC . F01L 1/022; F01L 1/344; F01L 1/352; F01L 2103/01; F01L 2820/032
USPC ..... 123/90.15, 90.17
See application file for complete search history.

(56) References Cited

U.S. PATENT DOCUMENTS 8,955,479 B2 * 2/2015 Shinomiya ..... F01L 1/34409 123/90.17

FOREIGN PATENT DOCUMENTS

JP 2009-236042 10/2009

* cited by examiner

*Primary Examiner* — Ching Chang
(74) *Attorney, Agent, or Firm* — Nixon & Vanderhye P.C.

(57) ABSTRACT

A valve timing controller includes a first housing; a second housing fixed to the first housing; a driven rotor inside of a driving rotor defined by the first housing and the second housing; a revolving actuator disposed on an extension of an axial direction of the driven rotor; a deceleration mechanism; and an engaging part that is engaged with a lock jig locking a relative rotation between the driving rotor and an input rotor of the deceleration mechanism in advance of assembling the valve timing controller to an internal-combustion engine. The engaging part is located on a radially inner side compared with an insertion part of the revolving actuator inserted in a hole of a cover component of the internal-combustion engine.

10 Claims, 19 Drawing Sheets

VALVE TIMING CONTROLLER, LOCK JIG FOR VALVE TIMING CONTROLLER, AND PRODUCTION METHOD OF VALVE TIMING CONTROLLER

CROSS REFERENCE TO RELATED APPLICATION

This application is based on Japanese Patent Application No. 2015-78341 filed on Apr. 7, 2015, the disclosure of which is incorporated herein by reference in its entirety.

TECHNICAL FIELD

The present disclosure relates to a valve timing controller, a lock jig for a valve timing controller, and a production method of a valve timing controller.

BACKGROUND

A valve timing controller has a driving rotor rotating with a crankshaft of an internal-combustion engine, a driven rotor rotating with a camshaft, and a deceleration mechanism disposed between the driving rotor and the driven rotor. The driven rotor is rotated relative to the driving rotor so as to control valve timing of a valve opened and closed by the camshaft. JP 4930427 B2 describes a production method of such a valve timing controller, in which a driving rotor and a driven rotor are respectively connected to a crankshaft and a camshaft while a lock jig locks a relative rotation between the driving rotor and an input rotor of a deceleration mechanism. The production of the valve timing controller can be completed in a state where the phase between the driving rotor and the driven rotor is set as a predetermined initial phase.

In a manufacturing process where a valve timing controller is assembled to an internal-combustion engine, there are a lock process locking a relative rotation between a driving rotor and an input rotor with a lock jig, a connection process connecting the driving rotor to a crankshaft with a chain and connecting the driven rotor to a camshaft with a bolt, and an unlock process of removing the lock jig from the driving rotor and the input rotor. The lock jig can be removed in case where these processes are performed continuously.

SUMMARY

It is an object of the present disclosure to provide a valve timing controller, a lock jig for a valve timing controller, and a production method of a valve timing controller which can be used in various factory lines.

According to an aspect of the present disclosure, a valve timing controller that controls valve timing of a valve opened and closed by a camshaft using a torque transferred from a crankshaft in an internal-combustion engine includes a first housing, a second housing, a driven rotor, a revolving actuator, and a deceleration mechanism. The first housing rotates with one of the crankshaft and the camshaft. The second housing is fixed to the first housing. The driven rotor is fixed to an end portion of the other of the crankshaft and the camshaft inside of a driving rotor defined by the first housing and the second housing. The revolving actuator is disposed on an extension of an axial direction of the driven rotor. The deceleration mechanism slows down and converts a relative rotation of the revolving actuator to the driving rotor into a relative rotation of the driven rotor to the driving rotor.

The valve timing controller further includes an engaging part. The engaging part is engaged with a lock jig locking a relative rotation between the driving rotor and an input rotor of the deceleration mechanism in advance of assembling the valve timing controller to the internal-combustion engine. The engaging part is located on a radially inner side compared with an insertion part of the revolving actuator inserted in a hole of a cover component of the internal-combustion engine.

According to an aspect of the present disclosure, a lock jig is used for manufacturing a valve timing controller including the first housing, the second housing, the driven rotor, the revolving actuator, the deceleration mechanism, and the engaging part. The lock jig locks a relative rotation between the input rotor of the deceleration mechanism and the driving rotor in advance of attaching the valve timing controller to the internal-combustion engine, and includes a first fitting part, a second fitting part, and a connecting part. The first fitting part is engaged with the input rotor in a circumferential direction. The second fitting part is engaged with the engaging part in a circumferential direction, while the engaging part is located on a radially inner side compared with the insertion part of the revolving actuator. The connecting part connects the first fitting part and the second fitting part. The size of the lock jig in the radial direction is smaller than that of the insertion part.

According to an aspect of the present disclosure, a method of producing a valve timing controller including a first housing, a second housing, a driven rotor, a revolving actuator, a deceleration mechanism, and an engaging part. The production method includes an assembly process, a lock process, a connection process, a cover attachment process, and an unlock process. In the assembly process, the first housing, the second housing, the driven rotor, and the deceleration mechanism are assembled. In the lock process, a relative rotation between the driving rotor and the input rotor of the deceleration mechanism is locked after the assembly process using a lock jig smaller than the insertion part in the size in the radial direction. In the connection process, after the lock process, the first housing is connected to one of the crankshaft and the camshaft, and the driven rotor is connected to the other of the crankshaft and the camshaft. In the cover attachment process, after the connection process, the cover component is attached to a main body of the internal-combustion engine. In the unlock process, after the cover attachment process, the lock jig is removed from the driving rotor and the input rotor to be taken out of the cover component through the hole.

Thus, the size of the lock jig in the radial direction can be easily made smaller than the insertion part of the actuator. Therefore, the lock jig can be taken out from the hole of the cover component which has a similar size as the insertion part, in a case where the cover component is attached to the main body of the internal-combustion engine in the state where the lock jig is attached. Accordingly, when the cover attachment process is set between the connection process and the unlock process, and when the connection process and the cover attachment process are continuously performed by an automatic machine, an operator can take out the lock jig from the cover component in the unlock process. The present disclosure can be applied to a factory line having the above manufacturing processes.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
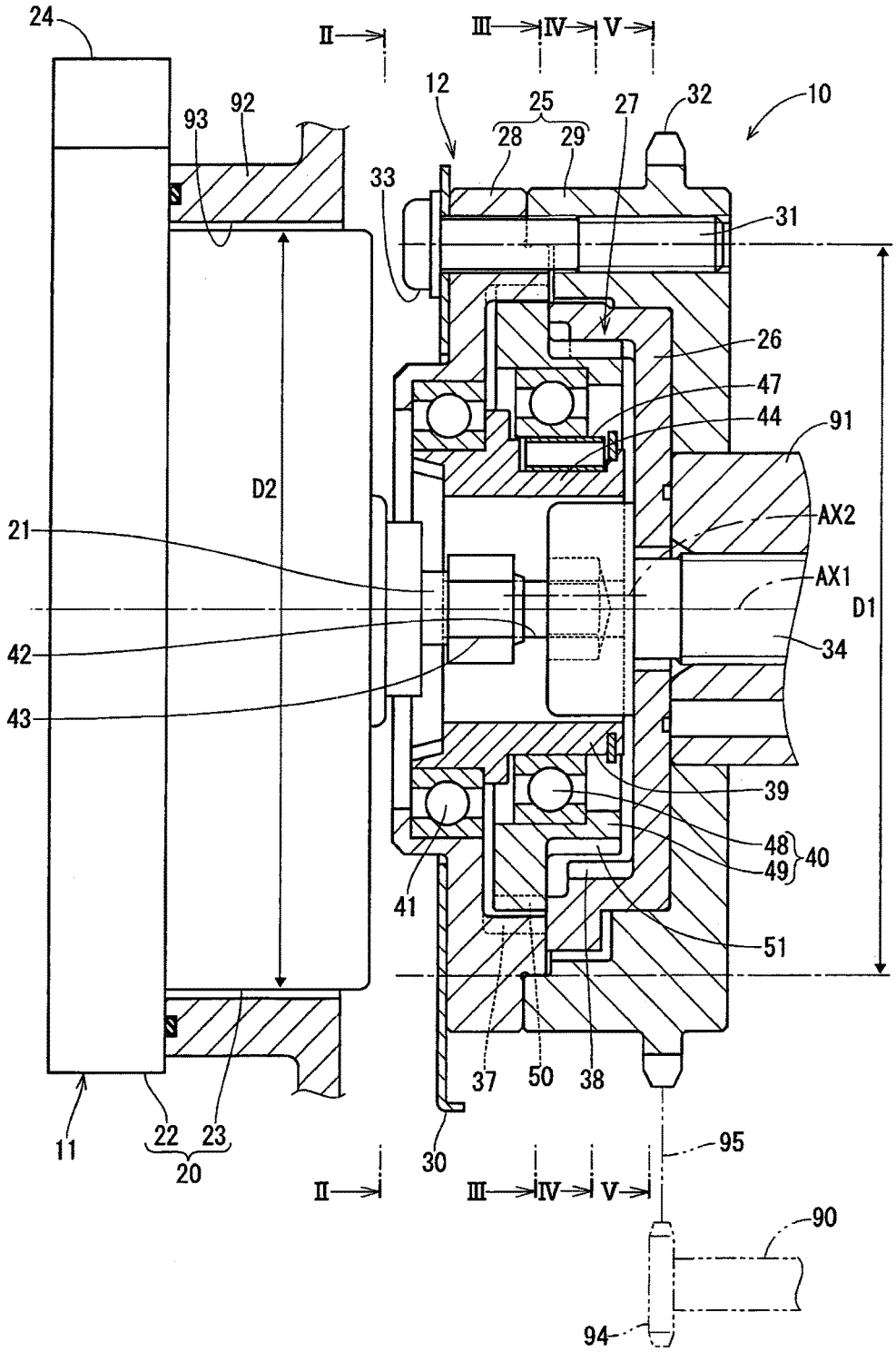
FIG. 1 is a sectional view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

FIG. 1 illustrates a valve timing controller 10 according to a first embodiment. The valve timing controller 10 is installed in a power train through which a torque of an internal-combustion engine of a vehicle is transmitted from a crankshaft 90 to a camshaft 91. The camshaft 91 opens and closes an intake valve (not shown) using the torque. The valve timing controller 10 controls the valve timing of the intake valve.

The valve timing controller 10 is explained with reference to FIG. 1 to FIG. 5. The valve timing controller 10 includes a revolving actuator 11 and a phase adjustment part 12.

As shown in FIG. 1, the revolving actuator 11 is an electric motor such as brushless motor, and is arranged on an extension of an axis (axial direction) of the camshaft 91. The revolving actuator 11 has a casing 20, a stator (not shown), a rotor (not shown), and a rotation shaft 21. The casing 20 is fixed to a chain cover 92 of the internal-combustion engine. The stator and the rotor are arranged in the casing 20. The rotation shaft 21 is connected to the rotor, and is supported by the casing 20 so as to be able to rotate in a right direction and a reverse direction. The chain cover 92 may correspond to a cover component. The casing 20 has an exposed part 22 located outside of the chain cover 92, and an insertion part 23 inserted into a hole 93 (through hole) of the chain cover 92. The rotation shaft 21 is projected toward the camshaft 91 from the insertion part 23.

The revolving actuator 11 has an energizing control part (not shown) disposed, for example, in the casing 20. The exposed part 22 has a connector 24 for electrically connecting the energizing control part to an external electronic control unit. The energizing control part has a drive driver, and a microcomputer for control. The rotation shaft 21 is rotated by controlling power supply to the stator by the energizing control part.

As shown in FIG. 1-FIG. 5, the phase adjustment part 12 has a driving rotor 25, a driven rotor 26, and a deceleration mechanism 27. The driving rotor 25 has a first housing 28, a second housing 29 and a signal plate 30 which are fastened with a bolt 31. The housing 28, 29 has a based cylindrical shape on a rotation axial center AX1 of the camshaft 91. The first housing 28 has a sprocket 32 formed integrally with the outer wall. The first housing 28 is connected to the crankshaft 90 through an annular timing chain 95 engaged with the sprocket 32 and a sprocket 94 of the crankshaft 90. When the torque of the crankshaft 90 is transmitted to the sprocket 32 through the timing chain 95, the driving rotor 25 is rotated with the crankshaft 90. The rotating direction of the driving rotor 25 is set clockwise in FIG. 2-FIG. 4.

Figure 2:
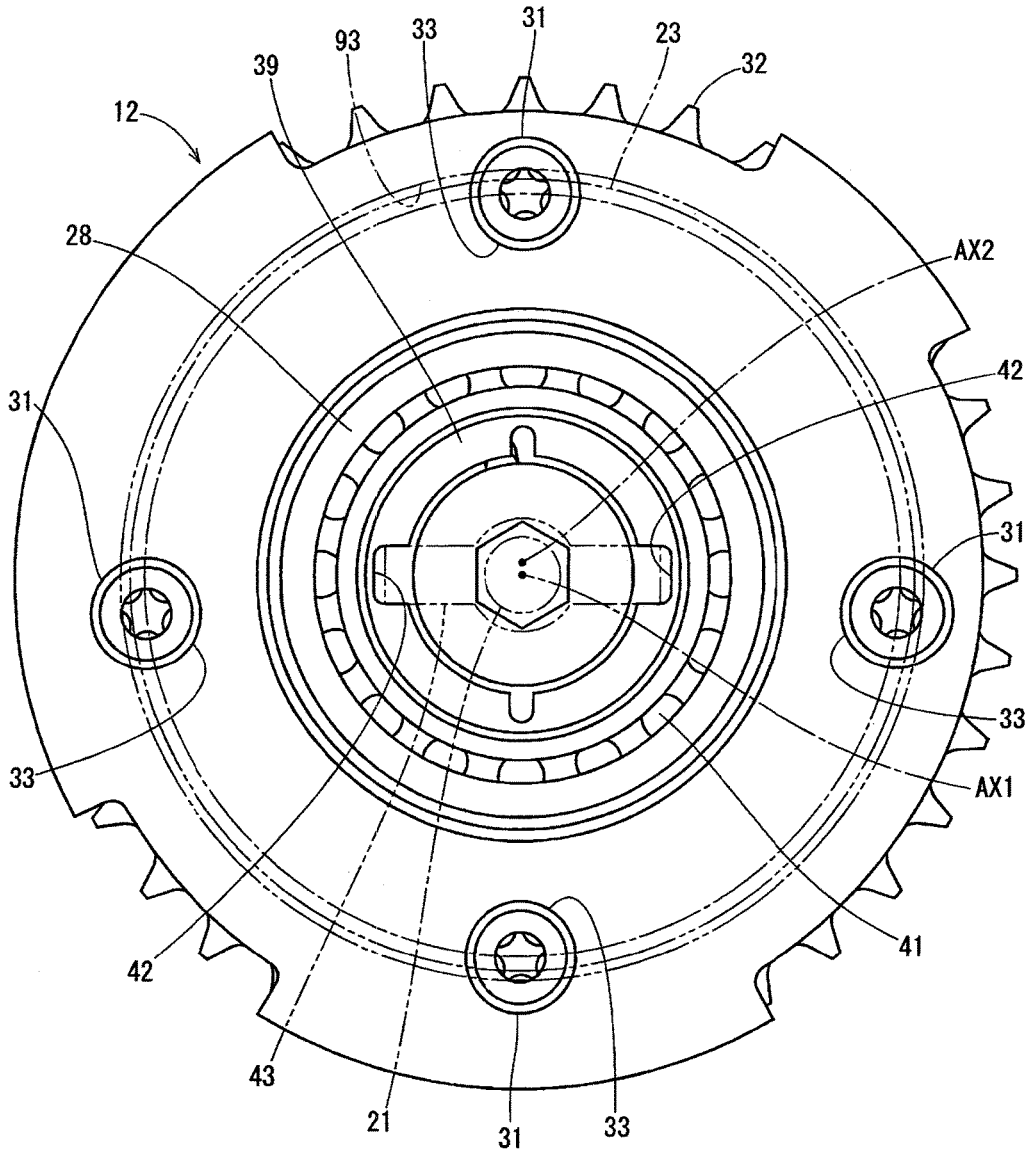
FIG. 2 is a side view illustrating a phase adjustment part of the valve timing controller seen from a chain cover side with respect to a line of II-II in FIG. 1.
Figure 3:
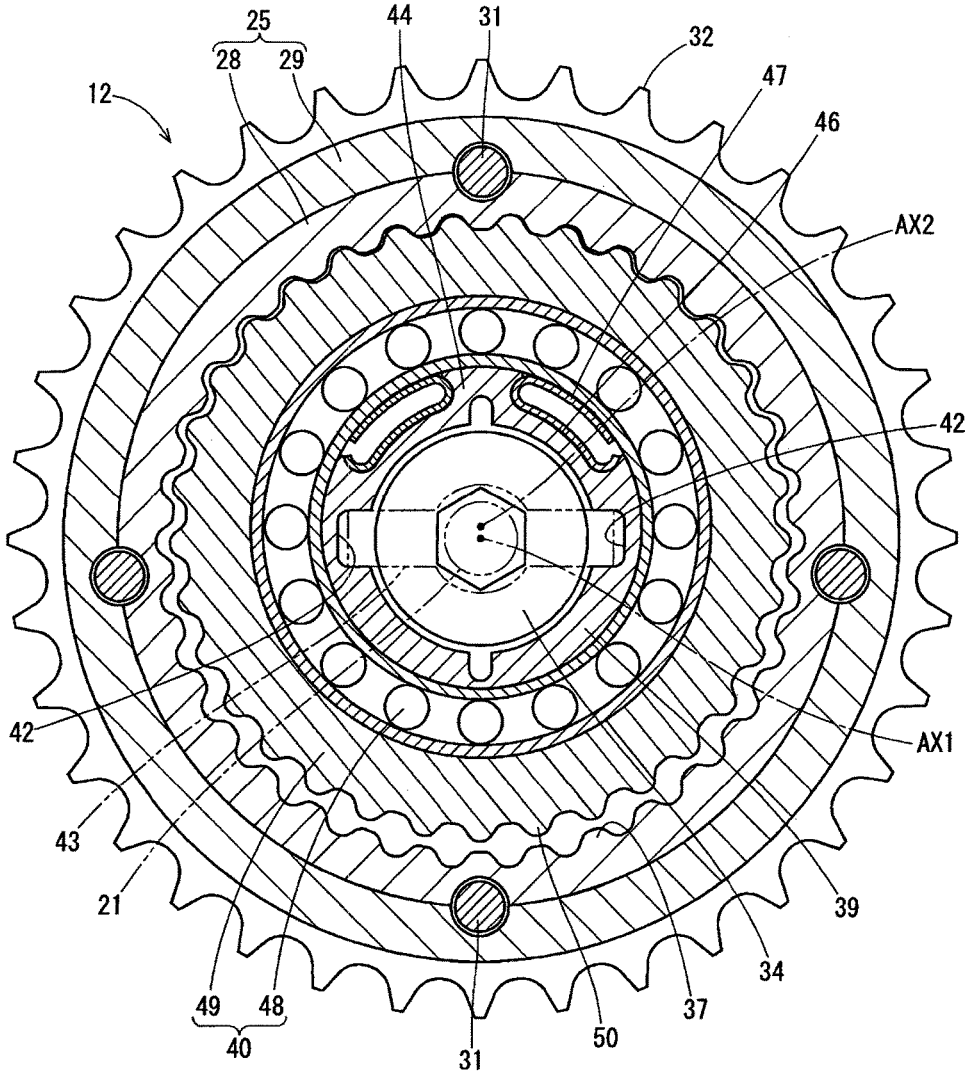
FIG. 3 is a cross-sectional view taken along a line III-Ill of FIG. 1.

The signal plate 30 is a disk component for making a cam angle sensor (not shown) to detect the rotation angle of the camshaft 91. As shown in FIG. 2, when the phase adjustment part 12 is seen from a side of the chain cover 92, the signal plate 30 covers the second housing 29 entirely.

The bolt 31 may correspond to a fastening component. The head of the bolt 31 is projected toward the insertion part 23 relative to the driving rotor 25. As shown in FIG. 1, the pitch diameter D1 of the bolts 31 is smaller than the outer diameter D2 of the insertion part 23. The pitch diameter D1 means a diameter of circle on which the bolts 31 are arranged as shown in FIG. 2. That is, a radially inner portion of the head of the bolt 31 that is at least on the inner side of the pitch diameter D1 is located on a radially inner side compared with the insertion part 23. As shown in FIG. 1 and FIG. 2, the radially inner portion is located on a radially inner side compared with the hole 93 having the equivalent size as the insertion part 23. In advance of attaching the valve timing controller 10 to the internal-combustion engine, when relative rotation between the driving rotor 25 and the input rotor 39 is locked with the lock jig, the radially inner portion corresponds to an engaging part engaged with the lock jig. Hereafter, the radially inner portion is indicated as an engaging part 33.

Figure 5:
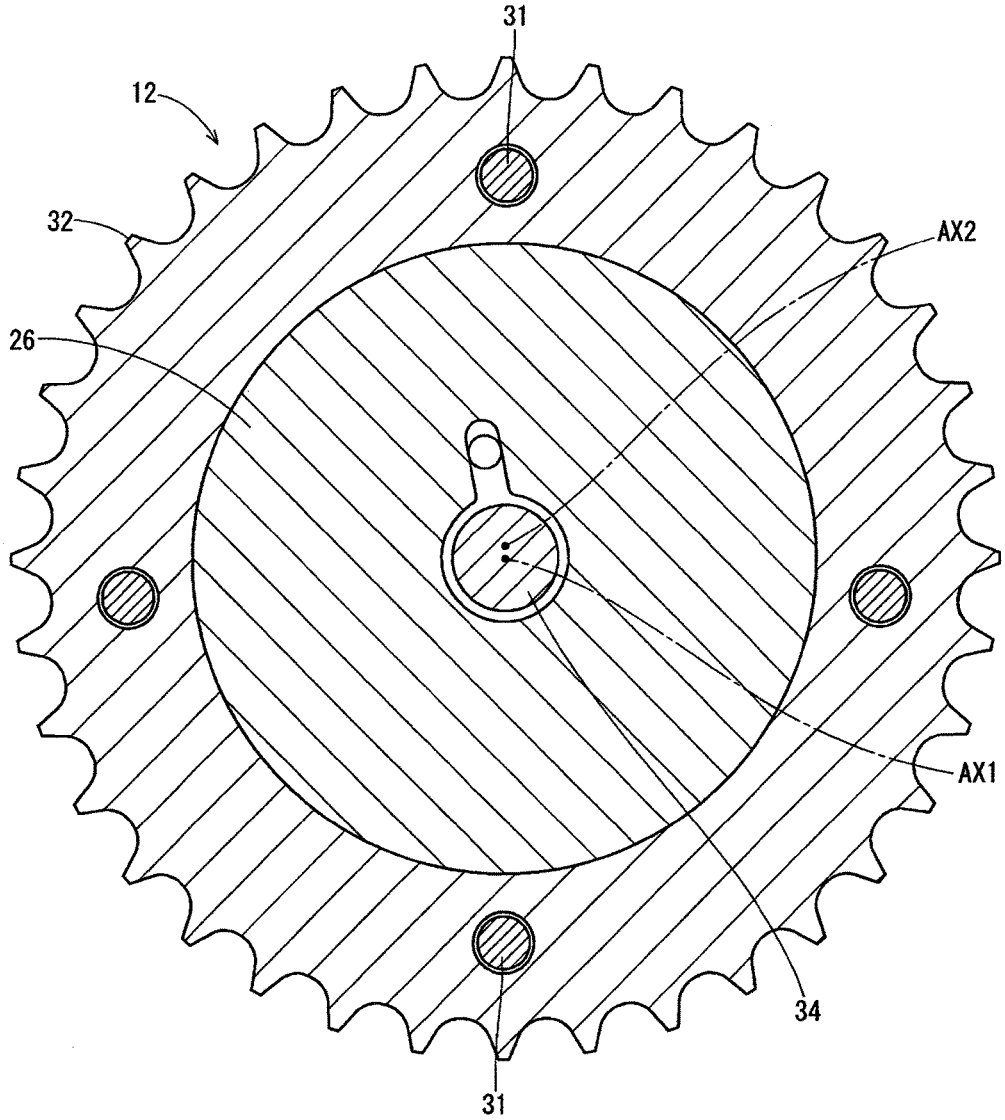
FIG. 5 is a cross-sectional view taken along a line V-V of FIG. 1.

As shown in FIG. 1 and FIG. 5, the driven rotor 26 has a based cylindrical shape, and is fitted into the circumference wall part of the first housing 28 so as to be rotateable relative to the driving rotor 25. The bottom wall part of the driven rotor 26 is directly fixed to an end portion of the camshaft 91 by a screw such as the center bolt 34. Therefore, the driven rotor 26 is rotated with the camshaft 91. The rotating direction of the driven rotor 26 is set clockwise in FIG. 5, the same as the driving rotor 25.

Figure 4:
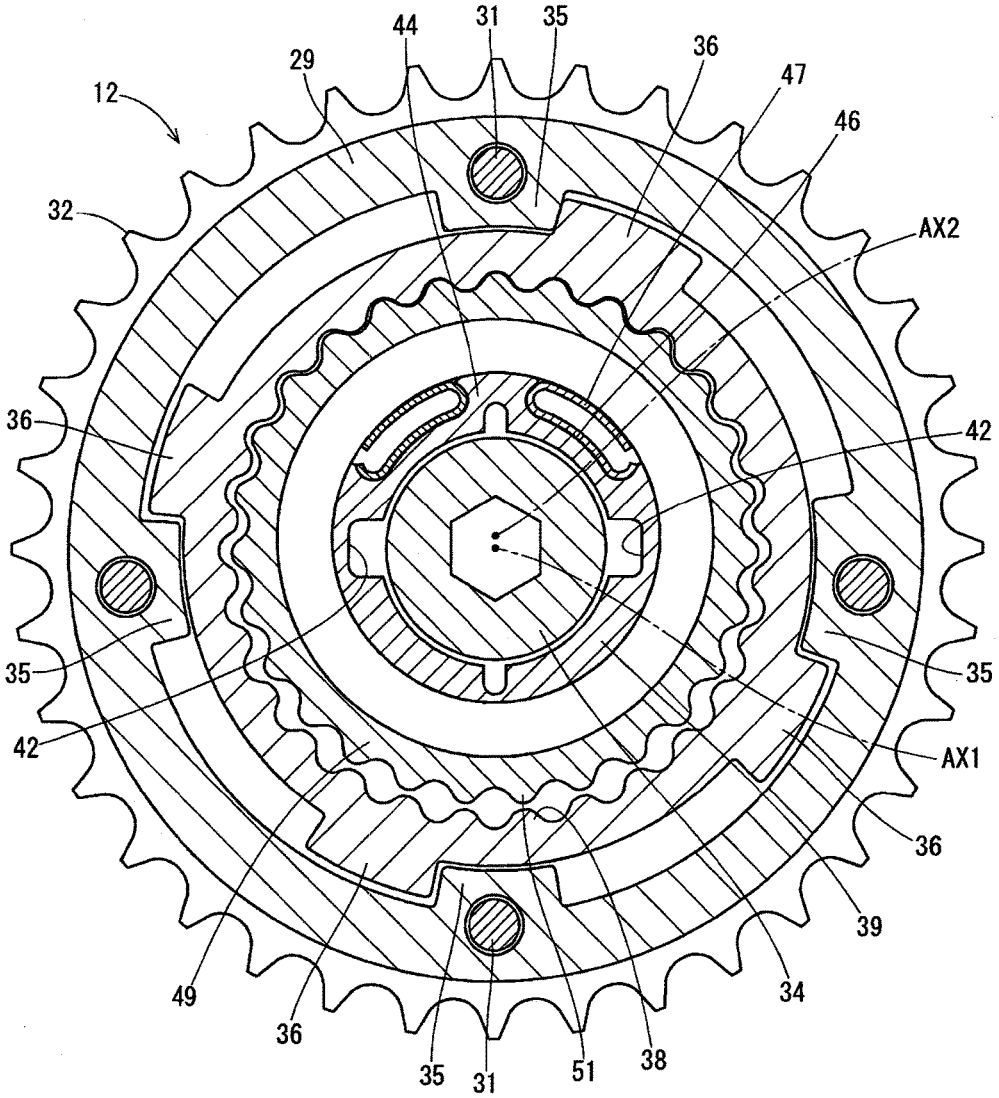
FIG. 4 is a cross-sectional view taken along a line IV-IV of FIG. 1.

As shown in FIG. 1 and FIG. 4, the driving rotor 25 and the driven rotor 26, respectively, have a driving side stopper part 35 and a driven side stopper part 36. The driving side stopper part 35 is projected inward at four places from the circumference wall part of the first housing 28 in the radial direction. The driven side stopper part 36 is projected in the radial direction outward at four places from the circumference wall part of the driven rotor 26.

As shown in FIG. 4, when the driven side stopper part 36 is in contact with the driving side stopper part 35 in a retard direction, a retard rotation of the driven rotor 26 relative to the driving rotor 25 is stopped, and the phase between the driving rotor 25 and the driven rotor 26 is regulated to the most retard phase. Hereafter, the phase between the driving rotor and the driven rotor is indicated as a phase between the rotors. In this embodiment, the most retard phase is set as an initial phase for permitting a starting of the internal-combustion engine.

When the driven side stopper part 36 is in contact with the driving side stopper part 35 in an advance direction, the relative rotation of the driven rotor 26 relative to the driving rotor 25 in the advance direction is stopped, and the phase between the rotors is regulated to the most advance phase.

As shown in FIG. 1-FIG. 4, the deceleration mechanism 27 is a planetary gear mechanism including a driving side internal gear part 37, a driven side internal gear part 38, an input rotor 39, and a planetary rotor 40.

The driving side internal gear part 37 is formed integrally with the inner wall of the circumference wall part of the second housing 29. The axial center of the driving side internal gear part 37 is in agreement with the rotation axial center AX1. The driving side internal gear part 37 may correspond to an annular gear. The bolt 31 is located at the same position in the circumferential direction as a tooth point part of the driving side internal gear part 37. In this embodiment, the four bolts 31 are arranged with non-regular intervals in the circumferential direction. Thereby, the engaging parts 33 are formed with non-regular intervals in the circumferential direction.

The driven side internal gear part 38 is formed integrally with the inner wall of the circumference wall part of the driven rotor 26. The axial center of the driven side internal gear part 38 is in agreement with the rotation axial center AX1. The diameter of the driven side internal gear part 38 is smaller than that of the driving side internal gear part 37. The number of teeth of the driven side internal gear part 38 is less than the number of teeth of the driving side internal gear part 37.

The input rotor 39 has a cylindrical shape as a whole, and is supported by the second housing 29 through a bearing 41 so as to be rotateable around the rotation axial center AX1. The bearing 41 is formed on the bottom wall part of the second housing 29. A pair of fitting grooves (two fit portions) 42 is formed on the inner wall of the input rotor 39, and extends in the axial direction. The fitting groove 42 is opened inward in the radial direction. The fitting groove 42 is extended from one end surface to the other end surface of the input rotor 39. A joint part 43 of the rotation shaft 21 is fitted to the fitting groove 42 such that the input rotor 39 is connected with the rotation shaft 21. The input rotor 39 can be rotated with the rotation shaft 21.

The input rotor 39 further has an eccentric part 44 eccentric to the rotation axial center AX1. A pair of recess portions 46 is defined in the eccentric part 44 on the eccentric side, and is opened outward in the radial direction. An elastic component 47 which generates restoring force is held in the recess portion 46. In this embodiment, the elastic component 47 is a metal board spring which has U-shape in the cross-section.

The planetary rotor 40 has a planetary bearing 48 and a planetary gear 49. The inner wheel of the planetary bearing 48 is arranged to the outer side of the eccentric part 44 of the input rotor 39 through a predetermined clearance. The planetary bearing 48 transmits the restoring force received from the elastic component 47 to the planetary gear 49 while being supported by the eccentric part 44 from the inner side through the elastic component 47.

The planetary gear 49 has a cylindrical shape with a projection, and is supported by the eccentric part 44 through the planetary bearing 48 to be rotateable around an eccentric center AX2. The large diameter part of the planetary gear 49 has a driving side external gear part 50 meshing with the driving side internal gear part 37. The small diameter part of the planetary gear 49 has a driven side external gear part 51 meshing with the driven side internal gear part 38. The number of teeth of the driving side external gear part 50 and the driven side external gear part 51 is respectively set less than the number of teeth of the driving side internal gear part 37 and the driven side internal gear part 38 by the same number. When the input rotor 39 rotates on the rotation axial center AX1, the planetary gear 49 has planetary movement revolving around the rotation axial center AX1 while rotating on the own axis around the eccentric center AX2. At this time, the rotation speed of the planetary gear 49 is slowed down to the revolving speed of the input rotor 39. The driven side internal gear part 38 and the driven side external gear part 51 correspond to a transmitting portion which transmits rotation of the planetary gear 49 to the driven rotor 26.

The phase adjustment part 12 controls the phase between the rotors 25 and 26 by slowing down and converting relative rotation of the revolving actuator 11 to the driving rotor 25 into relative rotation of the driven rotor 26 to the driving rotor 25. Specifically, when the rotation shaft 21 rotates at the same speed as the driving rotor 25, in case where the input rotor 39 does not carry out relative rotation to the driving rotor 25, the planetary gear 49 does not carry out planetary movement and is rotated with the rotors 25 and 26, such that the phase between the rotors is maintained.

When the input rotor 39 carries out relative rotation in the retard direction to the driving rotor 25, the rotation shaft 21 has low-speed rotation or rotates in the reverse direction relative to the driving rotor 25, the planetary gear 49 carries out planetary movement, and the driven rotor 26 is rotated in the retard direction to the driving rotor 25. Therefore, the phase between the rotors is retarded.

When the input rotor 39 carries out relative rotation in the advance direction to the driving rotor 25, the rotation shaft 21 carries out high-speed rotation compared with the driving rotor 25, the planetary gear 49 carries out planetary movement, and the driven rotor 26 is rotated in the advance direction to the driving rotor 25. Therefore, the phase between the rotors is advanced.

The production method of the valve timing controller 10 and the lock jig used for manufacturing the valve timing controller 10 are explained with reference to FIG. 6-FIG. 19.

Figure 6:
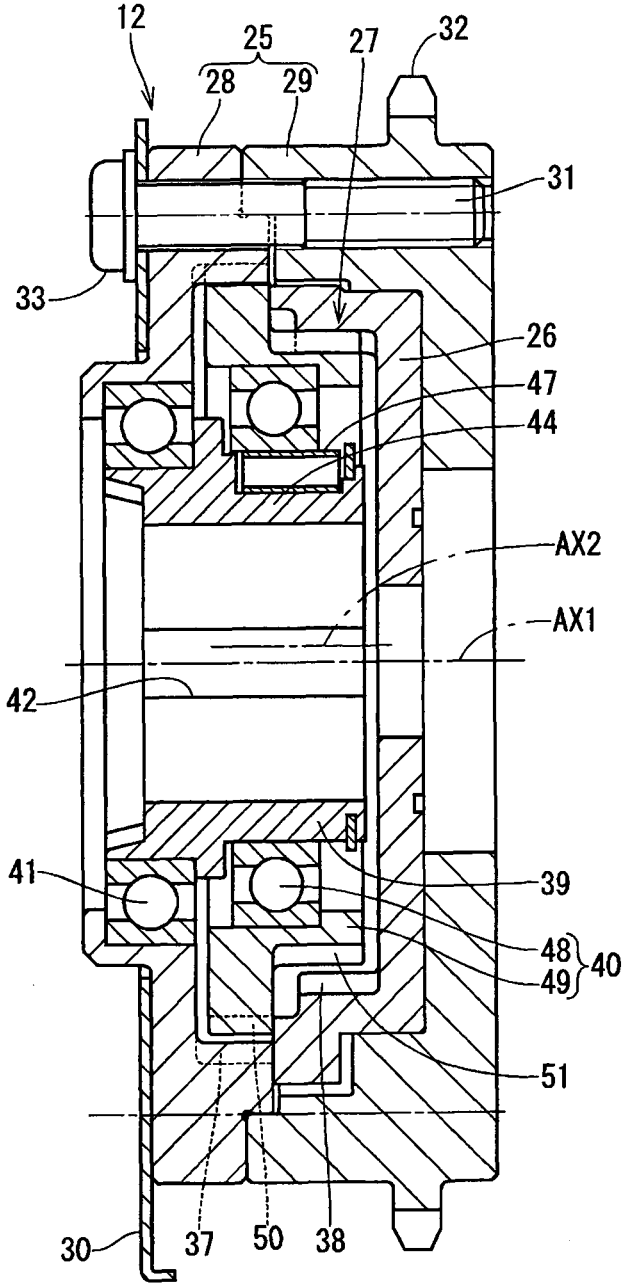
FIG. 6 is a sectional view illustrating the phase adjustment part of FIG. 1 assembled in an assembly process.
Figure 7:
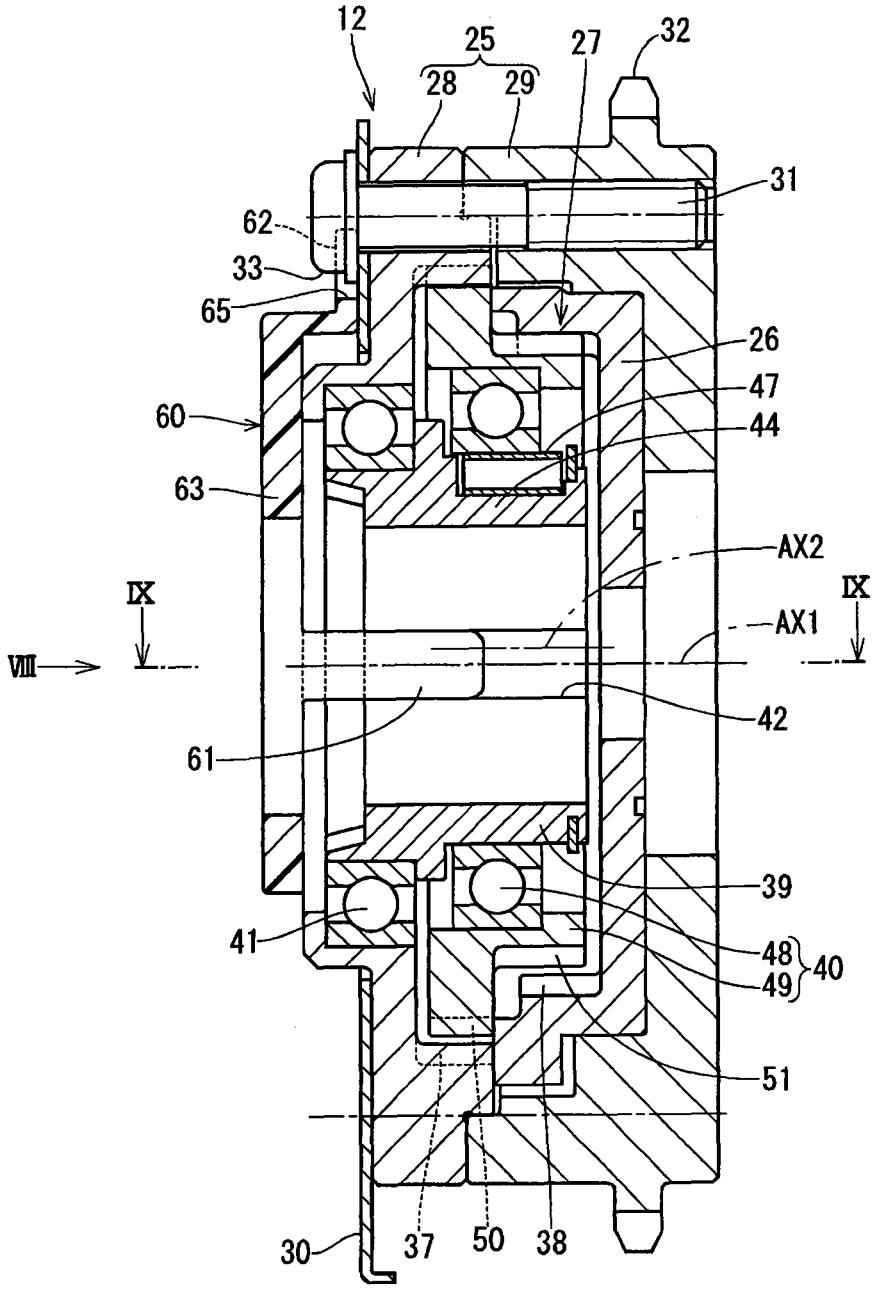
FIG. 7 is a sectional view illustrating a state where a relative rotation between a driving rotor and an input rotor is locked using a lock jig in a lock process.
Figure 8:
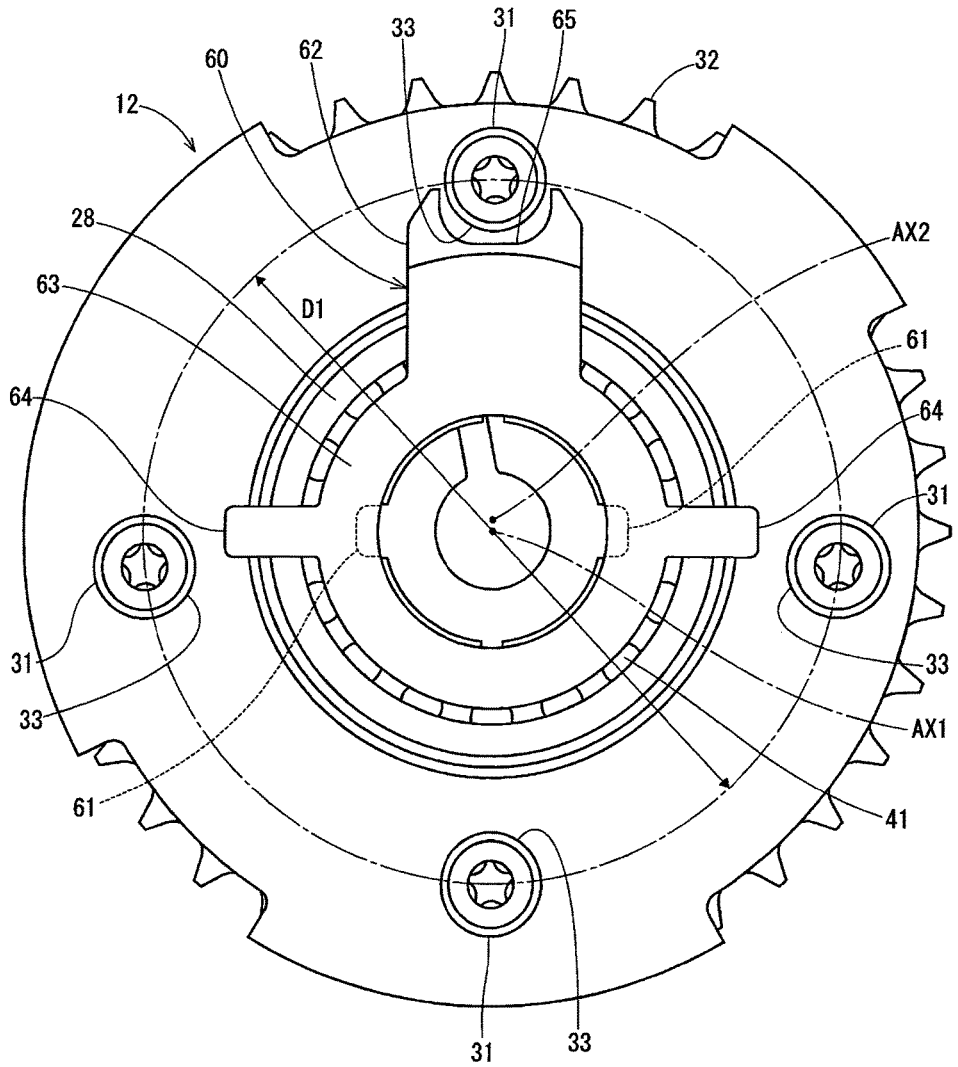
FIG. 8 is a side view seen from an arrow direction of VIII of FIG. 7.
Figure 9:
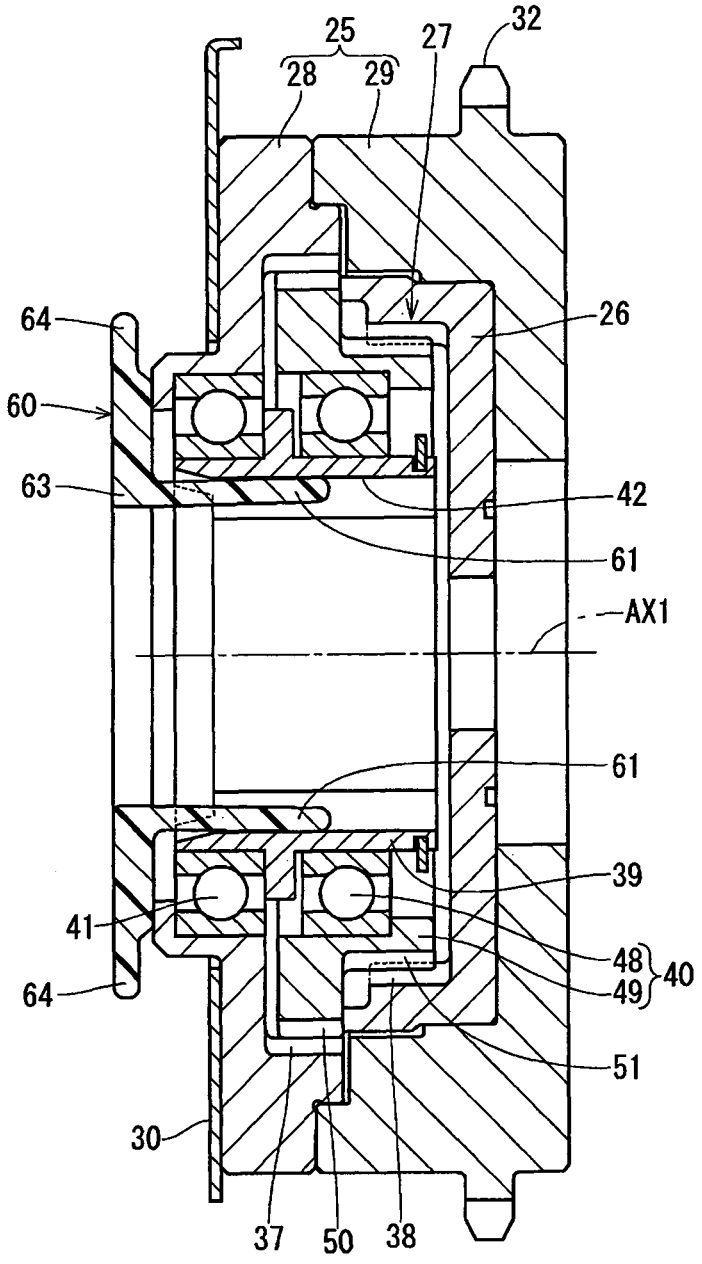
FIG. 9 is a cross-sectional view taken along a line IX-IX of FIG. 7.
Figure 10:
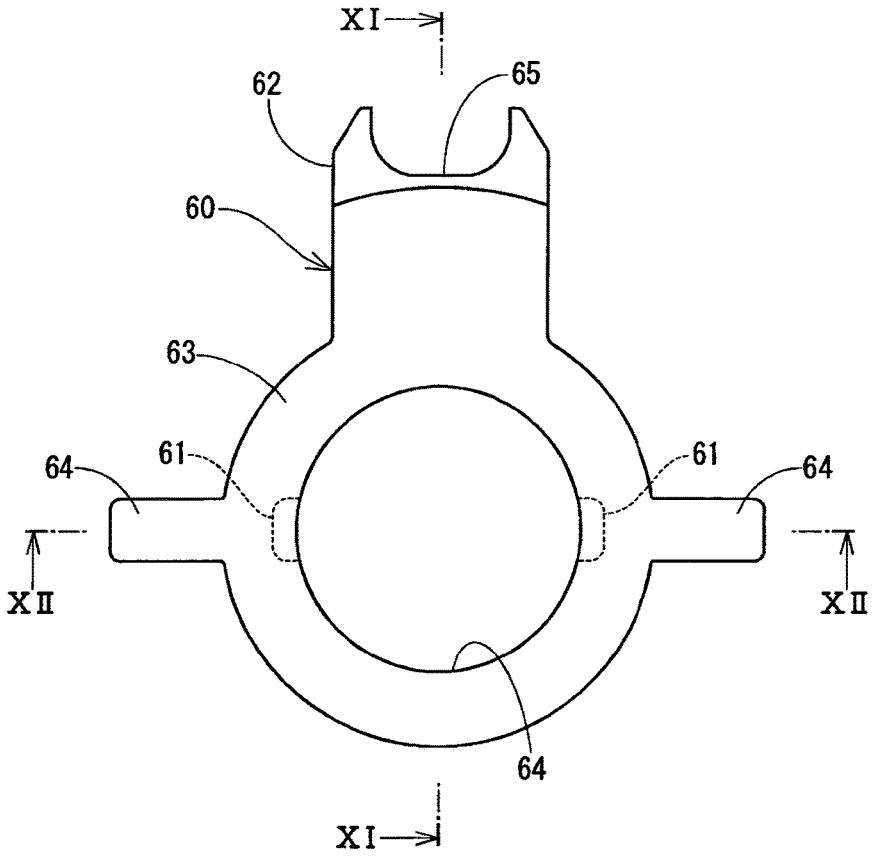
FIG. 10 is a view illustrating the lock jig of FIG. 8.
Figure 11:
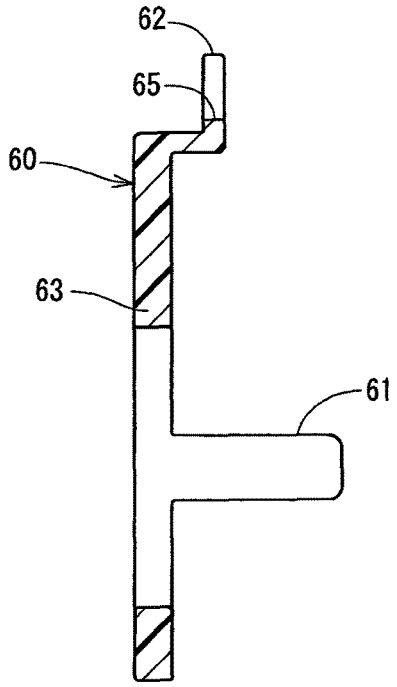
FIG. 11 is a cross-sectional view taken along a line XI-XI of FIG. 10.
Figure 12:
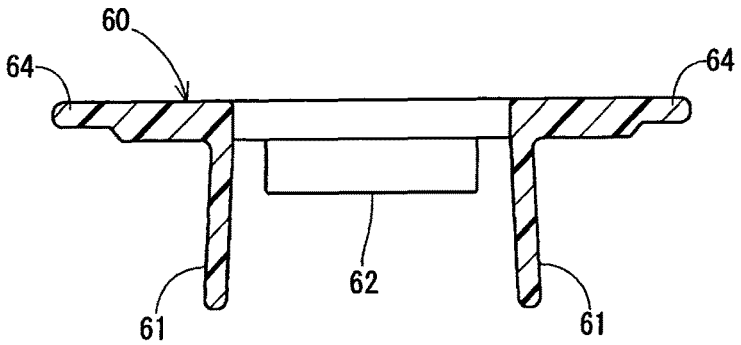
FIG. 12 is a cross-sectional view taken along a line XII-XII of FIG. 10.

In an assembly process, as shown in FIG. 6, the phase adjustment part 12 is assembled by combining the deceleration mechanism 27, the first housing 28, the second housing 29, the signal plate 30 and the bolt 31.

In a lock process, as shown in FIG. 7-FIG. 12, relative rotation between the driving rotor 25 and the input rotor 39 is locked using the lock jig 60. The lock jig 60 has a first fitting part 61 engaged with the input rotor 39 in the circumferential direction, a second fitting part 62 engaged with the engaging part 33 of the bolt 31 in the circumferential direction, and a connecting part 63 which connects the first fitting part 61 and the second fitting part 62.

The connecting part 63 has a circle shape, and has an operation arm 64 used at the time of operation.

The first fitting part 61 has two projections projected from the connecting part 63 in the axial direction and fitted to the fitting grooves 42 of the input rotor 39. The fitting groove 42 may correspond to a fit portion.

The second fitting part 62 is projected from the connecting part 63 in the radial direction, and has a recess portion 65 at the tip end. In the attachment state of the lock jig 60, the side wall of the recess portion 65 is engaged with the engaging part 33 in the circumferential direction.

The lock jig 60 is fabricated with metal, resin, and the like. In this embodiment, the lock jig 60 is made of elastically deformable material with hardness lower than that of the input rotor 39 in contact with the lock jig 60. The lock jig 60 is attached to the input rotor 39 by inserting the first fitting part 61 into the fitting groove 42 in the state where the tip parts of the first fitting parts 61 are elastically deformed to approach to each other. After the attachment, the first fitting part 61 is forced on the inner wall surface of the fitting groove 42 by elastic restoring force, and a frictional force is produced to prevent the lock jig 60 from separating from the input rotor 39. The size of the lock jig 60 in the radial direction is smaller than the insertion part 23 in the attachment state.

Figure 13:
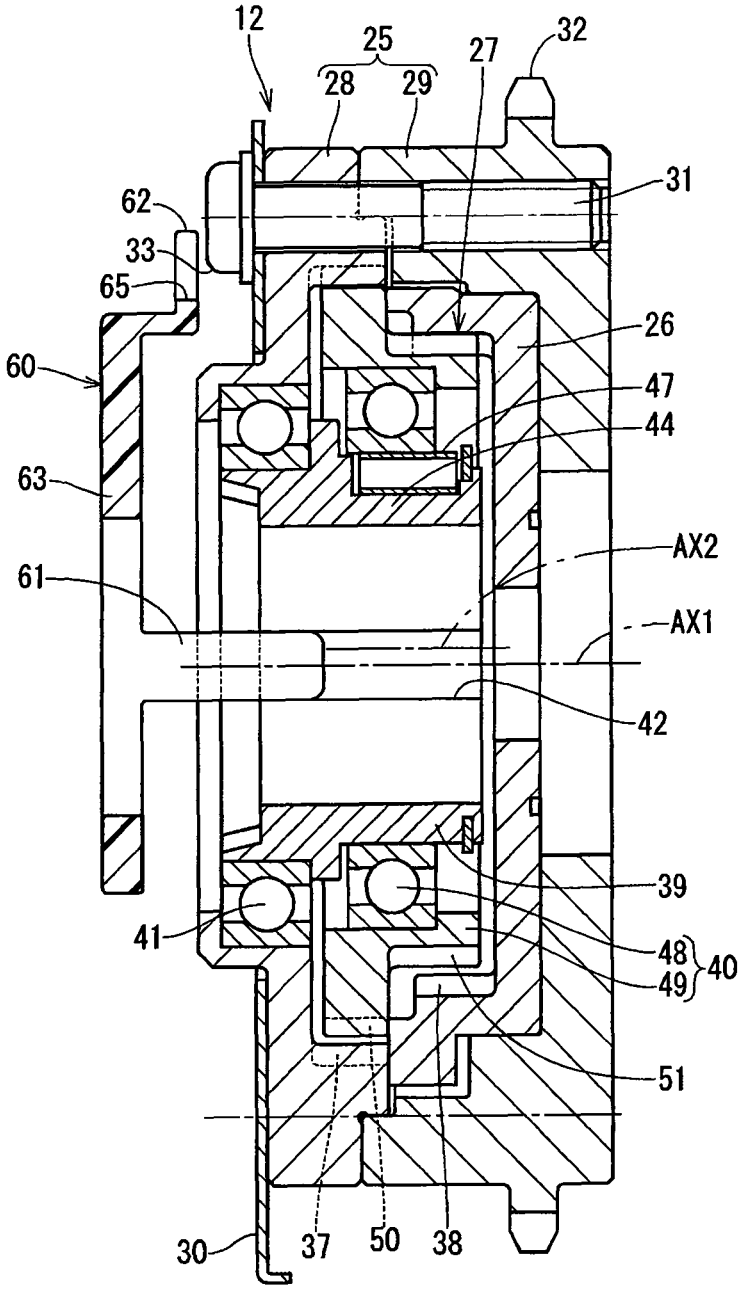
FIG. 13 is a sectional view illustrating the lock process in which a first fitting part of the lock jig is inserted in a fitting groove of the input rotor.

In the lock process using the lock jig 60, as shown in FIG. 13, the first fitting part 61 of the lock jig 60 is inserted to the middle in the fitting groove 42 of the input rotor 39 in the phase adjustment part 12. At this time, the second fitting part 62 and the engaging part 33 of the bolt 31 are kept from overlapping in the axial direction.

Figure 14:
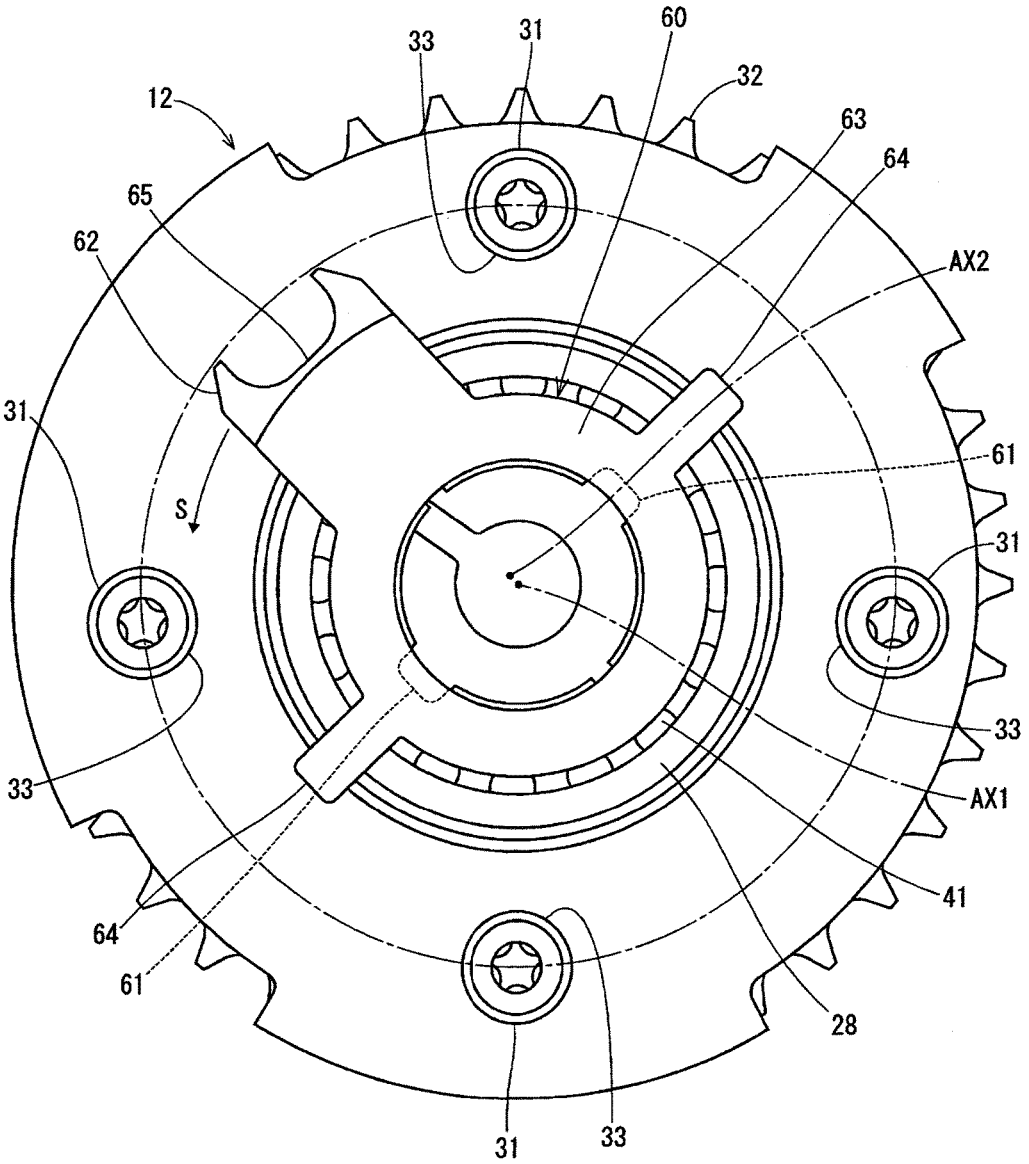
FIG. 14 illustrates the lock process in which the input rotor is rotated relative to the driving rotor in a setting direction.
Figure 15:
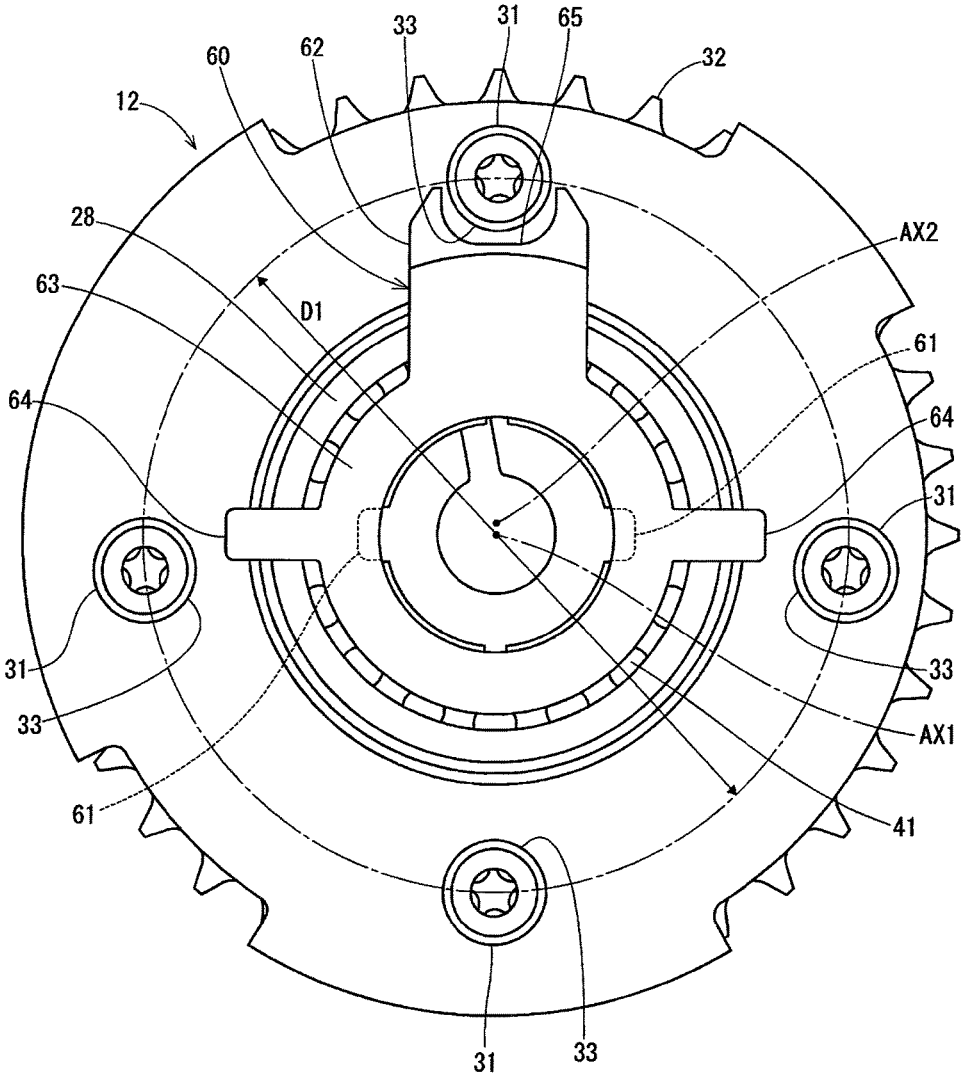
FIG. 15 illustrates the lock process in which a phase between the rotors is regulated to the most retard phase.

Then, the input rotor 39 is rotated relative to the driving rotor 25 in the setting direction S around the rotation axial center AX1 as shown in FIG. 14 by operating the connecting part 63 of the lock jig 60. In this embodiment, the setting direction S is a retard direction in which the driven rotor 26 is rotated in the retard direction relative to the driving rotor 25. The input rotor 39 is rotated in the setting direction S relative to the driving rotor 25 until the driven side stopper part 36 of the driven rotor 26 is in contact with the driving side stopper part 35 of the driving rotor 25 (see FIG. 4), such that the phase between the rotors is regulated to the most retard phase. When the phase between the rotors is regulated to the most retard phase, as shown in FIG. 15, the lock jig 60 is formed so that the bolt 31 and the recess portion 65 of the lock jig 60 overlap in the circumferential direction.

Then, the first fitting part 61 is fitted into the fitting groove 42 of the input rotor 39 (see FIG. 7), such that the second fitting part 62 of the lock jig 60 and the engaging part 33 of the bolt 31 overlap in the axial direction.

Accordingly, under the state where the phase between the rotors is regulated to the most retard phase, the first fitting part 61 is engaged with the fitting groove 42, and the second fitting part 62 is engaged with the engaging part 33 of the bolt 31. Therefore, the lock jig 60 can be attached so that the driven rotor 26 does not carry out relative rotation to the driving rotor 25.

In a conveyance process, the phase adjustment part 12 to which the lock jig 60 is attached in the lock process (see FIG. 7) is conveyed from the enforcement place of the lock process to the enforcement place of the connection process.

Figure 16:
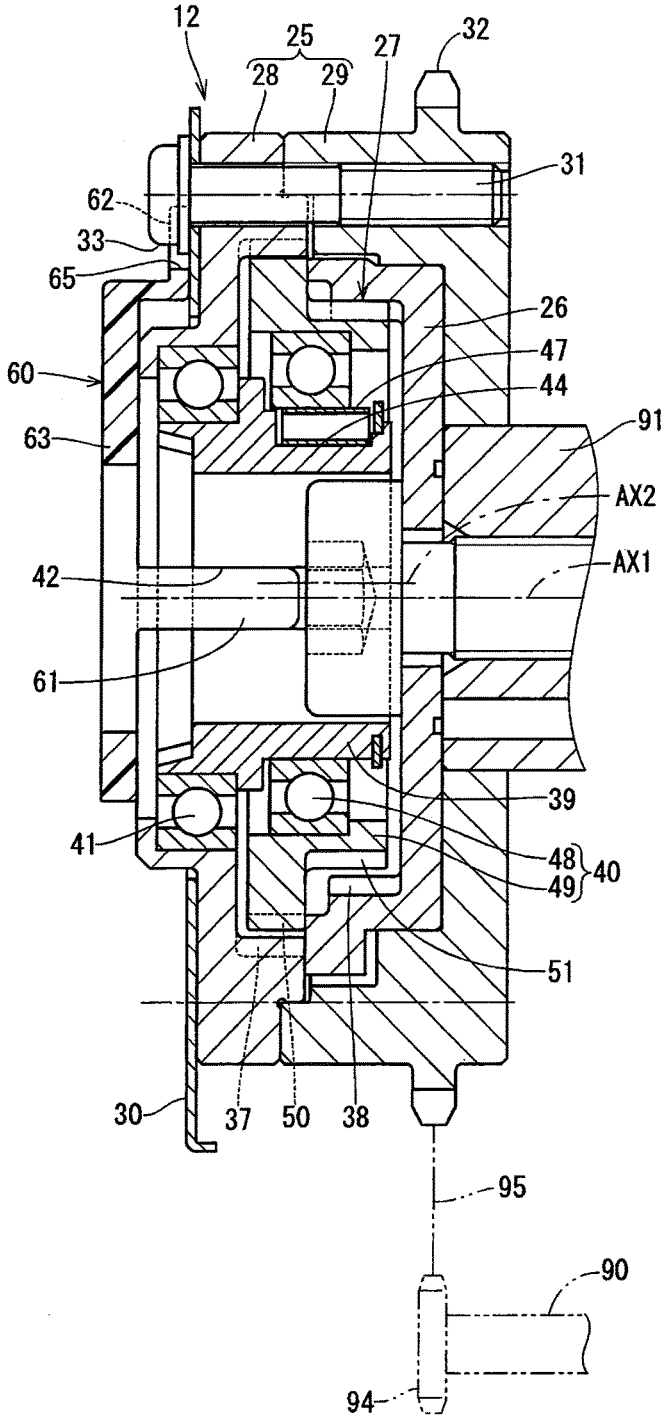
FIG. 16 is a sectional view illustrating a connection process in which the driven rotor is connected to a camshaft, and the driving rotor is connected to a crankshaft.

In a connection process, as shown in FIG. 16, the driven rotor 26 is fixed to the end surface of the camshaft 91 using the center bolt 34, such that the driven rotor 26 and the camshaft 91 are connected. Moreover, the driving rotor 25 and the crankshaft 90 are connected to each other through the annular timing chain 95 disposed between the sprocket 32 of the first housing 28 and the sprocket 94 of the crankshaft 90.

Figure 17:
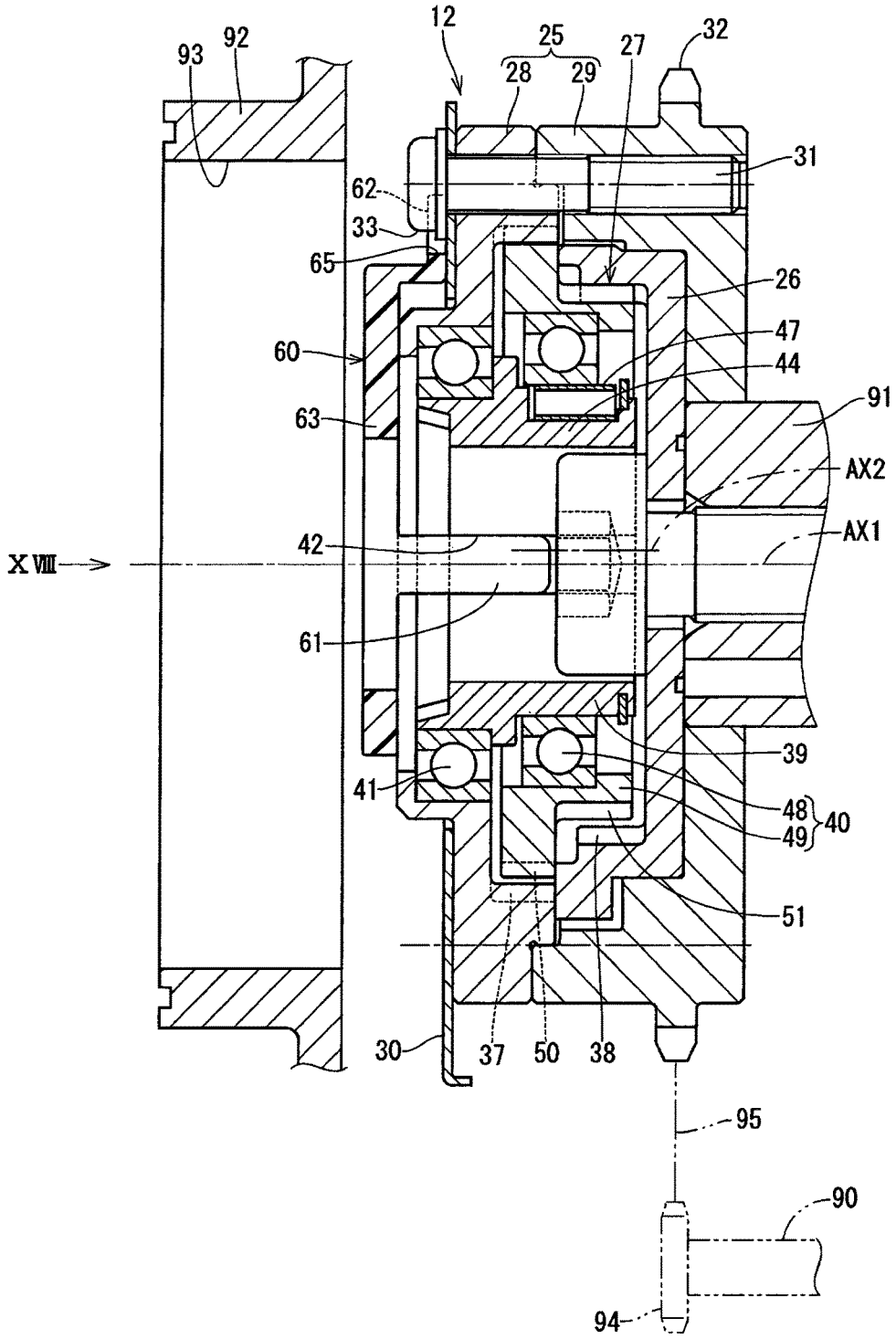
FIG. 17 illustrates a cover attachment process in which a chain cover is attached to a main body of an internal-combustion engine.
Figure 18:
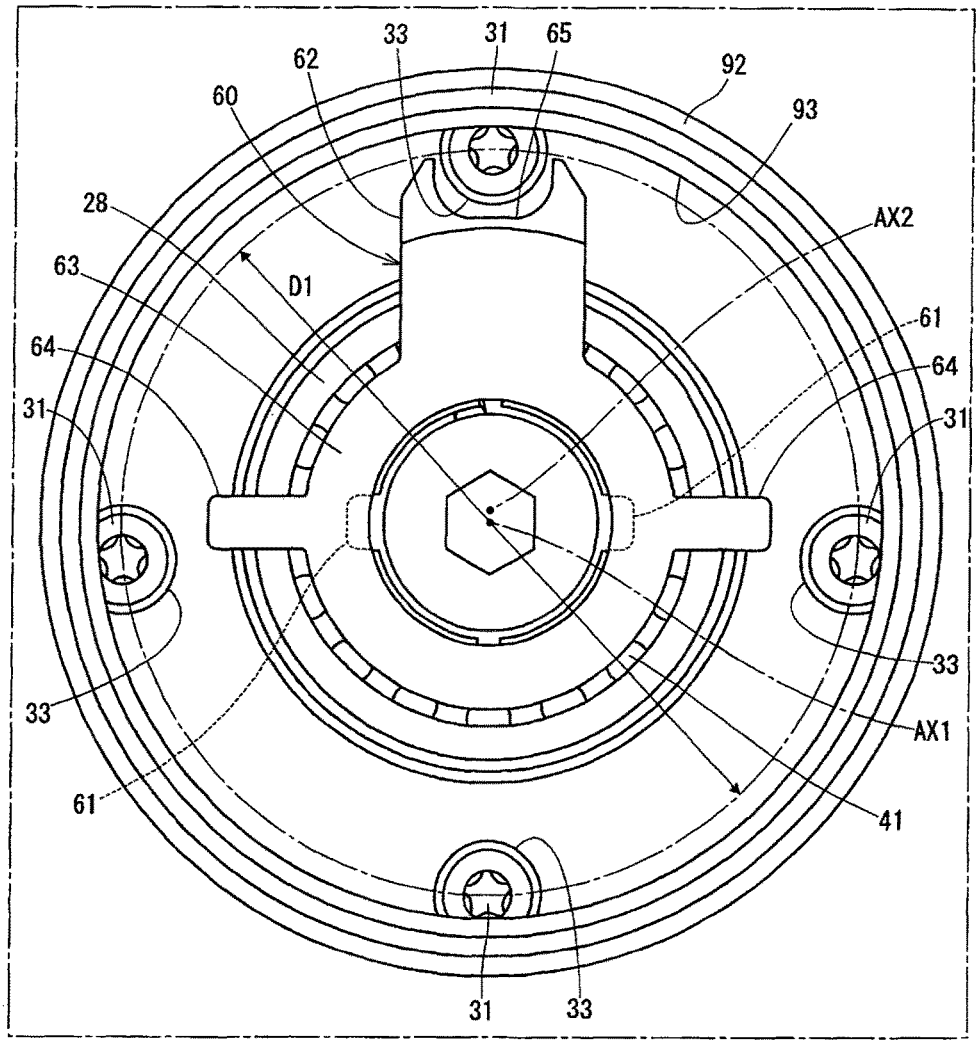
FIG. 18 is a view illustrating the chain cover and the phase adjustment part seen from an arrow direction XVIII of FIG. 17.

In a cover attachment process, as shown in FIG. 17 and FIG. 18, the chain cover 92 is attached to the main body of the internal-combustion engine.

Figure 19:
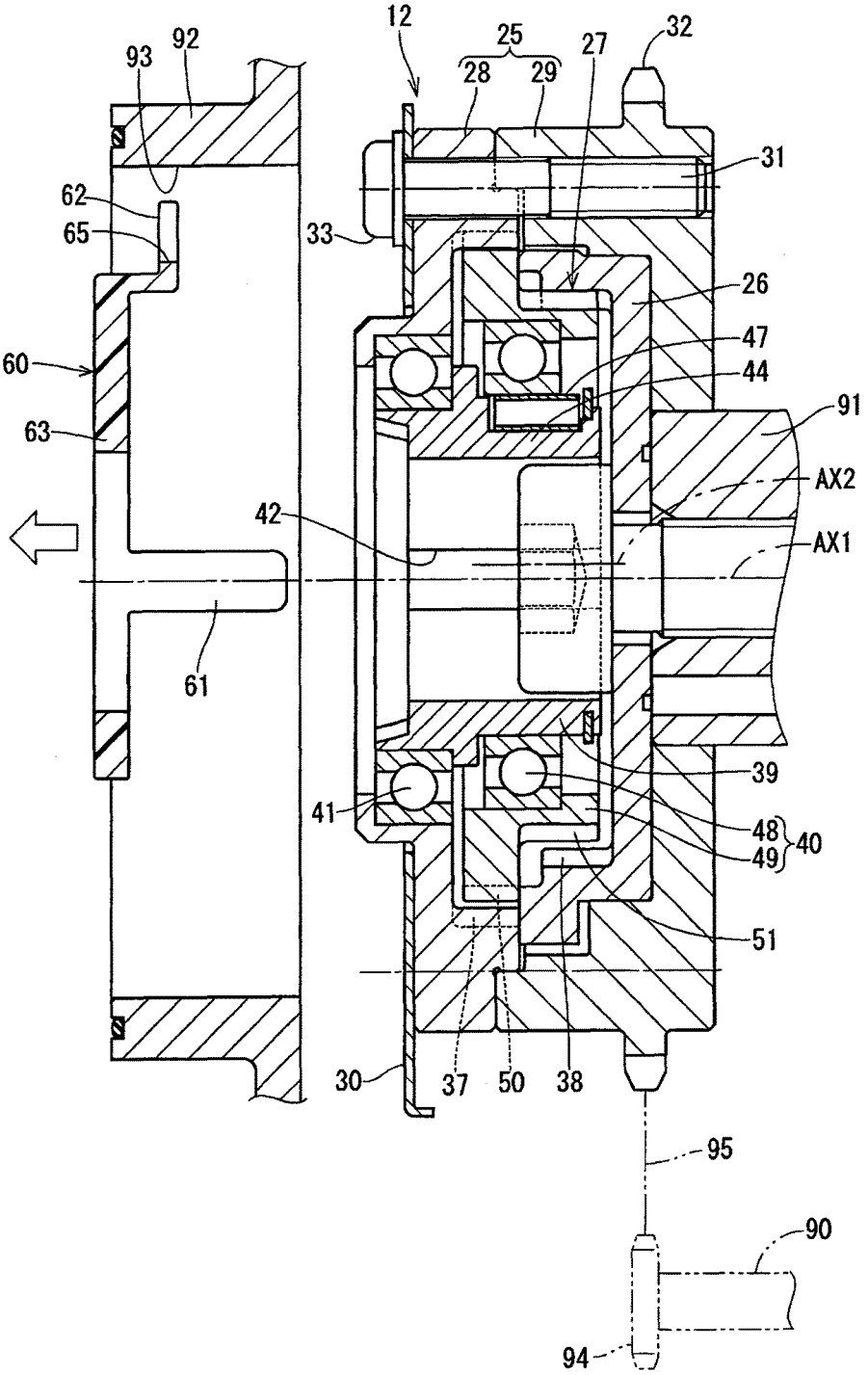
FIG. 19 is a sectional view illustrating an unlock process in which the lock jig is taken out of the chain cover through a hole.

In an unlock process, as shown in FIG. 19, the lock jig 60 is removed from the driving rotor 25 and the input rotor 39, and is taken out of the chain cover 92 through the hole 93.

In a coupling process, the joint part 43 of the rotation shaft 21 of the revolving actuator 11 is fitted to the fitting groove 42 of the input rotor 39 (see FIG. 1). Thus, the revolving actuator 11 and the input rotor 39 are coupled with each other. Then, if needed, the energizing control part is electrically connected with the revolving actuator 11 to complete the manufacturing of the valve timing controller 10.

According to the first embodiment, the valve timing controller 10 is equipped with the engaging part 33. The engaging part 33 is engaged with the lock jig 60 when relative rotation between the driving rotor 25 and the input rotor 39 is locked with the lock jig 60, in advance of attaching the valve timing controller 10 to the internal-combustion engine. The engaging part 33 is located on the radially inner side compared with the insertion part 23 which is a portion of the revolving actuator 11 inserted in the hole 93 of the chain cover 92 of the internal-combustion engine.

The lock jig 60 has the first fitting part 61, the second fitting part 62, and the connecting part 63. The first fitting part 61 is engaged with the input rotor 39 in the circumferential direction. The second fitting part 62 is engaged with the engaging part 33 in the circumferential direction. The connecting part 63 connects the first fitting part 61 and the second fitting part 62. The size of the lock jig 60 in the radial direction is smaller than the insertion part 23.

The production method of the valve timing controller 10 includes an assembly process, a lock process, a connection process, a cover attachment process, and an unlock process. In the lock process, relative rotation between the driving rotor 25 and the input rotor 39 is locked using the lock jig 60 that is smaller than the insertion part 23 in the radial direction. In the unlock process, after the cover attachment process, the lock jig 60 is removed from the driving rotor 25 and the input rotor 39, and the lock jig 60 is taken out of the chain cover 92 through the hole.

Thus, the size of the lock jig 60 can be easily made smaller than the insertion part 23 in the radial direction. Therefore, the lock jig 60 can be taken out from the hole of the chain cover 92 having the equivalent size as the insertion part 23 while the chain cover 92 is attached to the main body of the internal-combustion engine in the state where the lock jig 60 is attached. Therefore, an operator can take out the lock jig 60 from the chain cover 92 in the unlock process, when the cover attachment process is set between the connection process and the unlock process, and when the connection process and the cover attachment process are continuously performed by an automatic machine. Therefore, the first embodiment can be applied to a factory line with the above manufacturing processes, compared with a comparison example described below.

In the comparison example, a cover attachment process attaching a cover component such as chain cover to a main body of an internal-combustion engine is set between a connection process and an unlock process. Further, the connection process and the cover attachment process are continuously performed by an automatic machine. In such a case, an operator needs to remove the lock jig out of the cover component in the unlock process.

The cover component has a hole for inserting an actuator such as a motor driving a deceleration mechanism. The lock jig may be removed through the hole. However, in the comparison example, the lock jig is larger than the hole, and cannot be taken out from the hole. The valve timing controller, the lock jig, and the production method in the comparison example are not suitable for a factory line where the above manufacturing processes are set.

In contrast, according to the first embodiment, the engaging part 33 is a part of the bolt 31 which fastens the first housing 28 and the second housing 29. That is, the engaging part 33 is formed utilizing the bolt 31 that is prepared for fastening the first housing 28 and the second housing 29. Therefore, it is not necessary to newly form the engaging part 33 such as a projection on the driving rotor 25.

According to the first embodiment, the signal plate 30 is formed adjacent to the chain cover 92 relative to the second housing 29. Because the signal plate 30 covers the second housing 29 entirely, when the driving rotor 25 is seen from the chain cover 92, the second housing 29 cannot be engaged with the second fitting part 62 of the lock jig 60.

However, according to this embodiment, the second fitting part 62 of the lock jig 60 is engaged with a part of the head of the bolt 31 which fixes the signal plate 30 together. Therefore, the second fitting part 62 of the lock jig 60 can be engaged with the engaging part 33 while the signal plate 30 entirely covers the second housing 29.

In the first embodiment, the bolt 31 is formed at the same position as the tooth point part of the driving side internal gear part 37 of the deceleration mechanism 27 in the circumferential direction. Therefore, the engaging part 33 of the bolt 31 can be arranged as much as possible to the radially inner side while the strength of the driving side internal gear part 37 is secured. As a result, the size of the lock jig 60 can be made small in the radial direction, such that it becomes easy to take out the lock jig 60 through the hole 93 of the chain cover 92.

In the first embodiment, the engaging part 33 is formed at the four positions arranged in the circumferential direction with the non-regular intervals. Therefore, the phase between the rotors can be locked at the four positions while the input rotor 39 takes one round to the driving rotor 25. Moreover, the lock phase can be flexibly set by forming the engaging parts 33 with the non-regular intervals in the circumferential direction.

In the first embodiment, the lock jig 60 is attached to the input rotor 39 by being inserted into the fitting groove 42 in the state where the tip parts of the two first fitting parts 61 are elastically deformed to approach to each other. The frictional force produced by the first fitting part 61 forced on the inner wall surface of the fitting groove 42 due to the elastic restoring force can prevent the lock jig 60 from separating from the input rotor 39.

Second Embodiment

Figure 20:
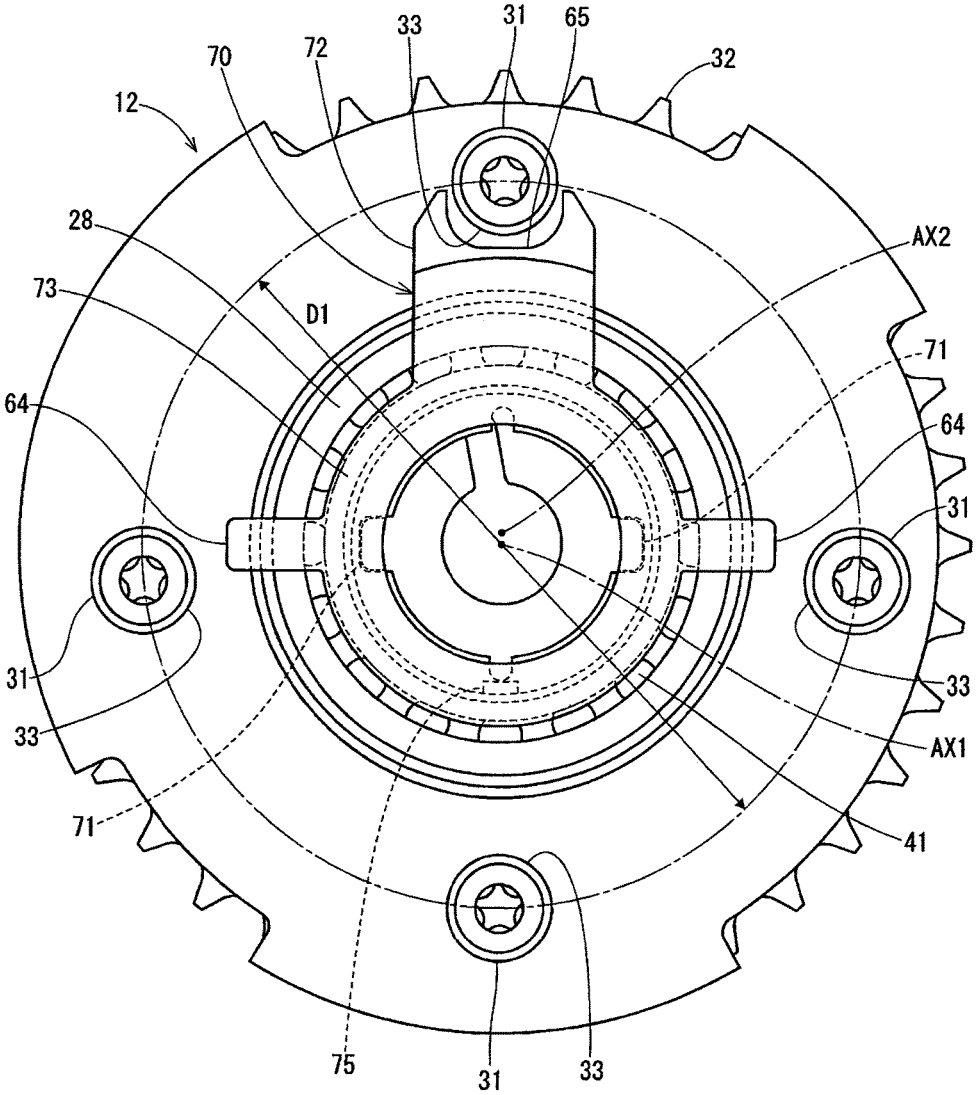
FIG. 20 is a view illustrating a valve timing controller and a lock jig according to a second embodiment.

In a second embodiment, as shown in FIG. 20, an eccentric direction mark 75 is formed on the end surface of the input rotor 39. The eccentric direction mark 75 is a mark indicating the eccentric direction of the eccentric part 44. The whole of the lock jig 70 including the first fitting part 71, the second fitting part 72, and the connecting part 73 is made of translucent material such as resin. Therefore, in the attachment state of the lock jig 70, the eccentric direction mark 75 located inside of the connecting part 73 can be sighted.

Other Embodiment

In other embodiment, the engaging part may be other part of the bolt such as a hole of the head that will be used at the time of fastening the bolt. The engaging part is not limited to the bolt which connects the first housing and the second housing. For example, other fastening component such as rivet which connects the first housing and the second housing may be used, and a positioning pin disposed in the driving rotor may be used.

A recess portion may not be formed on the tip end of the second fitting part in other embodiment. When the phase between the rotors is regulated to the most retard phase, the second fitting part may be located on the retard side relative to the engaging part, and the rotation in the advance direction may be restricted by the engaging part.

A relation between "advance" and "retard" may be reversed. In this case, the setting direction S may be an advance direction.

In other embodiment, the timing chain may be replaced with, for example, an annular timing belt as a torque transfer component which transmits the torque of the internal-combustion engine to the driving rotor from the crankshaft.

The revolving actuator may be an electromagnetic brake or a hydraulic motor other than the electric motor.

In other embodiment, the driving rotor may be connected to the camshaft, and the driven rotor may be connected to the crankshaft.

The valve timing controller may be applied not only to the intake valve but to an exhaust valve or both of the intake valve and the exhaust valve.

Such changes and modifications are to be understood as being within the scope of the present disclosure as defined by the appended claims.

What is claimed is:

1. A valve timing controller that controls valve timing of a valve opened and closed by a camshaft using a torque transferred from a crankshaft in an internal-combustion engine, the valve timing controller comprising:

a first housing rotating with one of the crankshaft and the camshaft;

a second housing fixed to the first housing;

a driven rotor fixed to an end portion of the other of the crankshaft and the camshaft inside of a driving rotor defined by the first housing and the second housing;

a revolving actuator disposed on an extension of an axial direction of the driven rotor;

a deceleration mechanism which slows down and converts a relative rotation of the revolving actuator to the driving rotor into a relative rotation of the driven rotor to the driving rotor; and an engaging part that is engaged with a lock jig locking a relative rotation between the driving rotor and an input rotor of the deceleration mechanism in advance of assembling the valve timing controller to the internal-combustion engine, wherein the engaging part is located on a radially inner side compared with an insertion part of the revolving actuator inserted in a hole of a cover component of the internal-combustion engine.

2. The valve timing controller according to claim 1, wherein the engaging part is a part of a fastening component which fastens the first housing and the second housing.

3. The valve timing controller according to claim 2, wherein the deceleration mechanism has an annular gear formed integrally with the second housing, the input rotor rotateable around an axial center of the annular gear, the input rotor having an eccentric part eccentric to the axial center, the input rotor being connected with the revolving actuator, a planetary gear engaged with the annular gear and supported by the eccentric part to be rotateable around an eccentric center, the planetary gear rotating on an own axis around the eccentric center and revolving around the axial center when the input rotor rotates around the axial center, and a transmitting portion that transmits rotation of the planetary gear to the driven rotor, and the fastening component is located at a same position as a tooth point part of the annular gear in a circumferential direction.

4. The valve timing controller according to claim 1, wherein the engaging part is one of a plurality of engaging parts arranged in a circumferential direction with non-regular intervals.

5. A lock jig for a valve timing controller that controls valve timing of a valve opened and closed by a camshaft using a torque transferred from a crankshaft in an internal-combustion engine, and that includes: a first housing rotating with one of the crankshaft and the camshaft; a second housing fixed to the first housing; a driven rotor fixed to an end portion of the other of the crankshaft and the camshaft inside of a driving rotor defined by the first housing and the second housing; a revolving actuator disposed on an extension of an axial direction of the driven rotor; a deceleration mechanism which slows down and converts a relative rotation of the revolving actuator to the driving rotor into a relative rotation of the driven rotor to the driving rotor; and an engaging part located on a radially inner side compared with an insertion part of the revolving actuator inserted in a hole of a cover component of the internal-combustion engine, the lock jig locking a relative rotation between the driving rotor and an input rotor of the deceleration mechanism in advance of assembling the valve timing controller to the internal-combustion engine, the lock jig comprising:

a first fitting part that is engaged with the input rotor in a circumferential direction;

a second fitting part that is engaged with the engaging part in a circumferential direction; and a connecting part which connects the first fitting part and the second fitting part, wherein a size of the lock jig in a radial direction is smaller than that of the insertion part.

6. The lock jig according to claim 5, wherein the engaging part is a part of a fastening component which fastens the first housing and the second housing.

7. The lock jig according to claim 5, wherein the input rotor has two fit portions extending in the axial direction, the first fitting part of the lock jig has two projections projected from the connecting part, and the lock jig is attached to the input rotor by inserting the two projections into the two fit portions respectively in a state where tip end parts of the two projections are elastically deformed to approach to each other.

8. The lock jig according to claim 5, wherein the deceleration mechanism, an annular gear formed integrally with the second housing, the input rotor rotateable around an axial center of the annular gear, the input rotor having an eccentric part eccentric to the axial center, the input rotor being connected with the revolving actuator, a planetary gear engaged with the annular gear and supported by the eccentric part to be rotateable around an eccentric center, the planetary gear rotating on an own axis around the eccentric center and revolving around the axial center when the input rotor rotates around the axial center, and a transmitting portion that transmits rotation of the planetary gear to the driven rotor, the input rotor has an eccentric direction mark indicating an eccentric direction of the eccentric part, and the connecting part is made of a translucent material so that the eccentric direction mark is recognized.

9. A production method of a valve timing controller that controls valve timing of a valve opened and closed by a camshaft using a torque transferred from a crankshaft in an internal-combustion engine, and that includes: a first housing rotating with one of the crankshaft and the camshaft; a second housing fixed to the first housing; a driven rotor fixed to an end portion of the other of the crankshaft and the camshaft inside of a driving rotor defined by the first housing and the second housing; a revolving actuator disposed on an extension of an axial direction of the driven rotor; a deceleration mechanism which slows down and converts a relative rotation of the revolving actuator to the driving rotor into a relative rotation of the driven rotor to the driving rotor; and an engaging part located on a radially inner side compared with an insertion part of the revolving actuator inserted in a hole of a cover component of the internal-combustion engine, the production method comprising:

assembling the first housing, the second housing, the driven rotor, and the deceleration mechanism;

locking a relative rotation between the driving rotor and an input rotor of the deceleration mechanism by using a lock jig after the assembling, a size of the lock jig being smaller than that of the insertion part in a radial direction;

connecting the first housing to one of the crankshaft and the camshaft and connecting the driven rotor to the other of the crankshaft and the camshaft after the locking;

attaching the cover component to a main body of the internal-combustion engine after the connecting; and removing the lock jig from the driving rotor and the input rotor to take out the lock jig outside through the hole of the cover component after the attaching.

10. The production method of the valve timing controller according to claim 9, wherein the engaging part is a part of a fastening component which fastens the first housing and the second housing.

* * * * *